US006324805B1

(12) United States Patent
Naniwa

(10) Patent No.: US 6,324,805 B1
(45) Date of Patent: Dec. 4, 2001

(54) STRUCTURAL REINFORCEMENT SYSTEM AND REINFORCING METHOD AT JOINT BETWEEN STRUCTURAL MEMBERS

(75) Inventor: Rentaro Naniwa, 4-9-5, Itabashi Itabashi-ku, Tokyo (JP)

(73) Assignees: Fukuvi Chemical Industry Co., Ltd.; Rentaro Naniwa, both of (JP)

( * ) Notice: Subject to any disclaimer, the term of this patent is extended or adjusted under 35 U.S.C. 154(b) by 0 days.

(21) Appl. No.: 09/522,806

(22) Filed: Mar. 10, 2000

(30) Foreign Application Priority Data

Mar. 17, 1999 (JP) ..... 11-072747

(51) Int. Cl.[7] ..... E04B 2/00
(52) U.S. Cl. ..... 52/431; 52/223.7
(58) Field of Search ..... 52/285.1, 585.1, 52/582.1, 745.13, 251, 259; 403/268, 286, 292, 293, 294

(56) References Cited

U.S. PATENT DOCUMENTS 5,440,845 * 8/1995 Tadros et al. ..... 52/309
5,809,712 * 9/1998 Simanjuntak ..... 52/223.7

OTHER PUBLICATIONS

Hawley's Condensed Chemical Dictionary, Eleventh Edition Sax, N. Irving, 1987, Van Nostrand Reinhold Company Inc., 467.*

* cited by examiner

*Primary Examiner*—Carl D. Friedman
*Assistant Examiner*—Steve M Varner
(74) *Attorney, Agent, or Firm*—Pitney, Hardin, Kipp & Szuch LLP

(57) ABSTRACT

In a structural reinforcement system of the present invention, a reinforcing material of a bundled fibrous material is positioned spanning a joint between structural members, and then opposite end sections of the reinforcing material are inserted into apertures formed in each of the structural members and fixed in place by anchoring with an adhesive. An angle formed between a center line of each aperture and a line connecting openings of the apertures should preferably ranges between 135° to 160°. The reinforcing material is preferably a bundle of fibers selected from the group consisting of aramid fiber, nylon fiber, carbon fiber, glass fiber, and steel fiber, and the bundle of fibers is impregnated with a resin.

11 Claims, 8 Drawing Sheets

STRUCTURAL REINFORCEMENT SYSTEM AND REINFORCING METHOD AT JOINT BETWEEN STRUCTURAL MEMBERS

BACKGROUND OF THE INVENTION

1. Field of the Invention

The present invention relates to a structural reinforcement system and a reinforcing method for reinforcing the joint sections between structural members applied in wooden buildings such as between a concrete continuous footing and a sill, a concrete continuous footing and a sill and a post, a sill and a post, a sill and a brace, a post and a beam, a post and a girder, two different beams, a beam and a girder or a girt, or alternatively for reinforcing the joint sections between structural members or masonry units such as concrete blocks, pre-cast concrete, stone, or brick.

2. Description of the Related Art

In recent years, the collapse of buildings and concrete block walls and the like due to strong earthquakes has become a major problem. For example, a particular cause of the collapse of wooden buildings is the portions where a sill and a post, a post and a beam, or a beam and a girder are joined via a tenon and/or a joint, and cases have been substantiated where the vibration of an earthquake has caused the tenon to pull out, or the joint to be destroyed.

As a result, in the recent construction of new wooden buildings, joints between members such as sills, posts, braces and beams have been reinforced by using various types of mounting materials such as nails, bolts, and nuts to attach steel fixtures such as hold down bolts or angle plate reinforcing metal struts to the external side, or both sides of the structural members.

However, in the case of the reinforcement of joints in existing buildings, use of the structural reinforcement system s described above would require the removal of interior finishing of the buildings to expose the joints, and consequently the earthquake proofing reinforcement of existing wooden buildings using the above structural reinforcement systems has proved to be difficult.

In addition, thought has been given to simplifying the attachment of the metal reinforcement fixtures by using nails or screws to attach the reinforcement fixtures to the joints from the outside. However, there are inherent problems with such a technique, such as a deterioration in strength and durability in comparison with a structure using a bolt and nut which is fixed from both the inside and the outside, a lack of reliability of the reinforcement, and a lack of aesthetic appeal of the resulting exterior.

Furthermore, in the case of a structural reinforcement system using the above type of metal reinforcement fixtures, there are also problems of durability, as dew condensation will form on the metal reinforcement fixtures, resulting in rust and corrosion. Moreover, there is also a danger that as a result of the dew condensation generated on the metal reinforcement fixtures, the sills, posts, and beams will deteriorate, and will invite termite damage.

Furthermore, in the case where metal reinforcement fixtures are used to fix rigidly a joint section, there is a danger that the shock during an earthquake will not be absorbed and dispersed, and it will act directly on the structural members, resulting in the rupture of the structural members.

SUMMARY OF THE INVENTION

The present invention takes the above problems into consideration, with an object of providing a highly reliable structural reinforcement system and reinforcing method for the joint sections of structural members, which is easy to install, has excellent durability, and give less damage to the structural members, moreover it can also be used in existing buildings.

In order to achieve the above object, a structural reinforcement system for joint sections of structural members of the present invention is a structural reinforcement system for reinforcing joints between associated structural members wherein a reinforcing material of a bundled fibrous material is positioned spanning the joint between the structural members, and then opposite end sections of the reinforcing material are inserted into apertures respectively formed in the structural members and fixed in place by anchoring with an adhesive.

Because the joint between the structural members is reinforced with a reinforcing material of a fibrous material with excellent tensile strength, then when vibration resulting from an earthquake or the like is applied to the joint, undesirable occurrences such as the joint rupturing and the tenon pulling out can be prevented. Consequently, the collapse of the buildings or other structures reinforced by this structural members can be prevented.

Furthermore in comparison with reinforcement by metal fixtures, the reinforcement using the present invention is able to absorb the shock applied to the joints, and release the stresses. In particular, by making the fibrous material a twisted type (rope type) or braided type material, the shock absorption capability of the material is increased even further. Moreover, in contrast to metal fixtures, the reinforcing material is able to be cut, enabling the length to be freely adjusted as required by the circumstances. In addition, the problem of dew condensation does not cause, and rust resulting from condensation cannot occur. Furthermore, because dew condensation does not develop, the problems of deterioration in the structural members, and termite damage can also be avoided. In addition, the fibrous material does not lose the aesthetic appeal of the building as shown in the metal fixtures.

It is also possible to have the entire reinforcing material, or alternatively a portion of the reinforcing material impregnated with a resin. In those cases where the reinforcing material is a fibrous material into which has been impregnated a resin, the fibrous material which makes up the reinforcing material can be maintained in a bundled state, thereby improving the handling and workability.

In a reinforcing method for joint sections between structural members according to the present invention, apertures are formed in the joined structural members, the apertures are filled with an adhesive, and then the opposite end sections of a reinforcing material comprising a bundled fibrous material are inserted in the apertures and fixed in place by anchoring with the adhesive. With this method, the joints between structural members can be reinforced with a reinforcing material comprising a fibrous material of superior tensile strength. Consequently when vibration is applied to a joint during an earthquake or the like, undesirable occurrences such as the joint rupturing or the tenon pulling out can be prevented. As a result, the collapse of buildings or other structures constructed from such structural members can be prevented.

Furthermore, in comparison with those cases where reinforcement is conducted using metal fixture reinforcement, the reinforcement is carried out with a reinforcing material which is lightweight, is not bulky, and which is easy to handle. Therefore an installation operation which is simple and displays excellent operating efficiency can be achieved, and the transportation and carrying of the reinforcing material is also easy. Moreover, in comparison with metal fixtures, the fibrous reinforcing material is more able to absorb any shock applied to the joints of the structural members, and disperse the stress, and moreover avoid dew condensation problems, meaning rust will not develop. Furthermore, because dew condensation does not develop, the problems of deterioration in the structural members, and termite damage can also be avoided. Moreover the fibrous material does not affect the aesthetic appeal of the building in the same way as metal fixtures.

In terms of fireproofing, the reinforcing material has heat resistant characteristics at temperatures above the permissible temperature for timber of 260° C., and it is ideally suited for use in fire protection construction type external walls. Furthermore, even if the anchoring of the reinforcing material by adhesive is carried out during winter, the insulating characteristics of timber mean that the temperature inside the apertures will not fall too low, and will be maintained at a temperature suitable for the curing of the adhesive.

DESCRIPTION OF THE PREFERRED EMBODIMENTS

A description, based on the drawings, of embodiments of structural reinforcement systems and reinforcing methods for reinforcing the joint sections of structural member is as follows according to the present invention.

Figure 1:
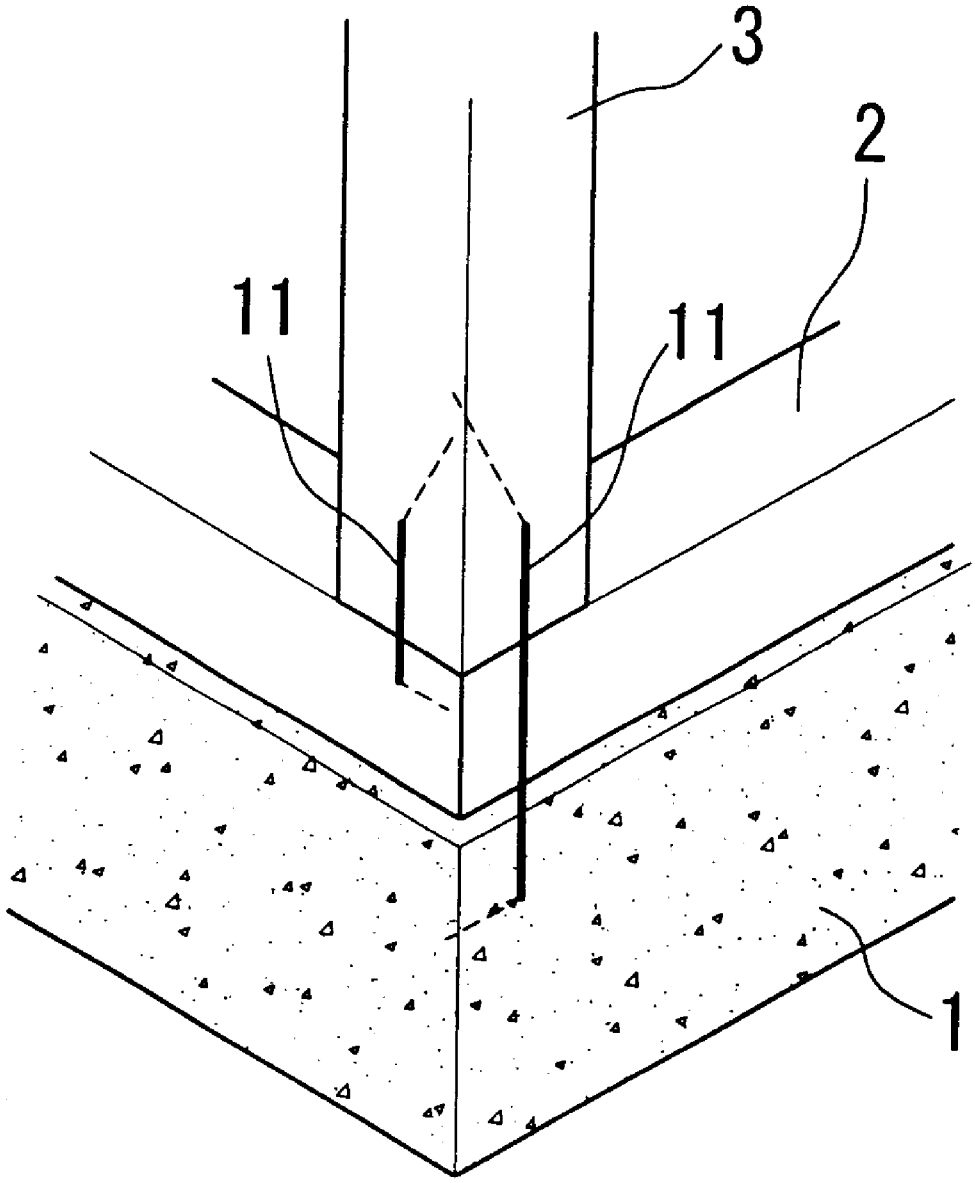
FIG. 1 is a perspective view showing a structural reinforcement system of a joint section of structural members according to an embodiment of the present invention.

In FIG. 1, numeral 1 denotes a concrete continuous footing. A sill 2 is fixed to the upper surface of the concrete continuous footing 1. A post 3, such as a corner post, is fixed vertically on the top surface of the sill 2.

A tenon (not shown in the drawing) is formed on the end of the post 3, and by engaging the tenon into a mortice (not shown in the drawing) formed in the sill 2, the post 3 is joined vertically to the sill 2 in an upright state. A structural reinforcement system is attached to the framework of the joint between the sill 2 and the post 3.

Numeral 11 denotes a reinforcing material. The reinforcing material 11 is installed in a position spanning the joint (joint section) between the post 3 and the sill 2, and in a position spanning the joint between the post 3, the sill 2 and the concrete continuous footing 1.

The reinforcing material 11 is a bundled fibers, and examples of suitable fibrous materials with superior tensile strength include either one, or two or more, of the materials selected from organic materials such as nylon fiber and aramid fiber, inorganic materials such as carbon fiber and glass fiber, and metallic fibers such as steel fiber. Furthermore, a plurality of fibers can be bundled in parallel to form the reinforcing material 11, or alternatively a plurality of fibers can be twisted to form a twisted rope type material, or woven to form a braided type material.

Next is a description of the installation structure of the reinforcing material 11, using the reinforcing material fitted across the joint between the sill 2 and the post 3 as an example.

Figure 2:
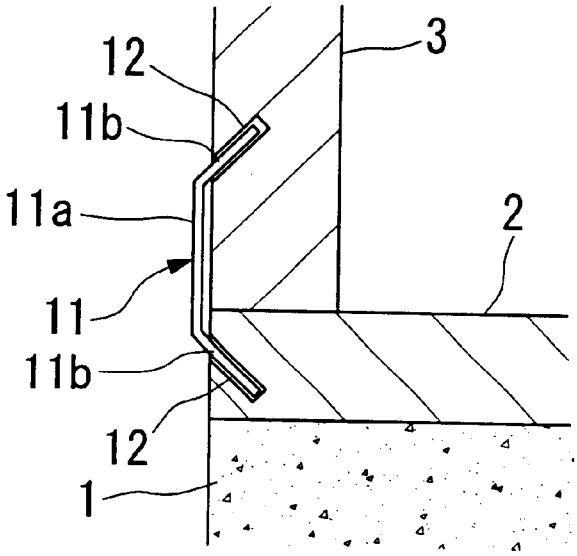
FIG. 2 through FIG. 7 are cross-sectional views, each showing a structural reinforcement system of a joint section of structural members according to an embodiment of the present invention.

As shown in FIG. 2, open apertures 12 are formed on the surface of the structural members of the sill 2 and the post 3. The apertures 12 are formed at an angle so that the distance between the apertures increases with movement from the aperture openings deeper into each aperture.

Figure 3:
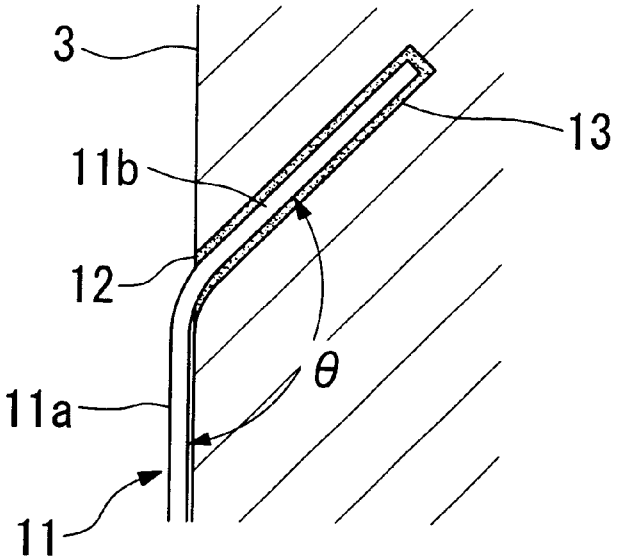

The opposite end sections of the rod shaped reinforcing material 11 are inserted into the respective apertures 12, and the inserted reinforcing material 11 is then fixed in place inside the apertures 12 with an adhesive 13, as shown in FIG. 3.

The anchored sections 11*b*, comprising the opposite end sections of the reinforcing material, are inserted into the apertures 12, and then they are anchored in place with the adhesive 13, bent with respect to a bonded section 11*a* comprising an intermediate portion of the reinforcing material 11. There are no particular restrictions on the type of adhesive 13 used, but single liquid, or double liquid epoxy resin type adhesives are effective.

The bend angle θ between the bonded section 11*a* and the anchored sections 11*b* is set to an obtuse angle of approximately 150°. Any angle could be used for the bend angle θ between the bonded section 11*a* and the anchored sections 11*b*, but obtuse angles are preferable in terms of maximizing strength, with angles between 135 to 160° being even more desirable, and angles of approximately 150° being particularly suitable. The internal corner of the aperture 12, at the bend point between the bonded section 11*a* and the anchored section 11*b*, is curved, with the corner having been smoothed off.

There are no restrictions on the thickness of the reinforcing material 11, but applicable values for use in a standard house should preferably be between 3 to 20 mm, with values between 5 to 13 mm being even more desirable. Thickness values within this range result in good workability. The diameter of the apertures 12 should preferably be between 2 to 1.2 times the diameter of the reinforcing material 11, with diameters of 1.5 to 1.3 times the diameter of the reinforcing material 11 being even more desirable. Values within this range result in good workability and good anchoring strength by the adhesive 13.

There are no restrictions on the depth of the apertures 12, but applicable values for use in a standard house should preferably be between 60 to 200 mm, with values between 80 to 140 mm being even more desirable. Depths within this range resulted in good anchoring strength (adhesive strength) by the adhesive 13, with low cost.

In the installation of a structural reinforcement system using the reinforcing material 11 on the joint between the sill 2 and the post 3, first apertures 12 are formed in both the sill 2 and the post 3. Then the adhesive 13 is inserted inside the apertures 12. After this the anchoring sections 11*b* of the reinforcing material 11 are inserted in the apertures 12, and the intermediate bonded section 11*a* is flattened out into a straight line.

In this manner, by using the joint structural reinforcement system and reinforcing method described above, the joints between structural members such as the concrete continuous footing 1, the sill 2 and the post 3 are reinforced with a reinforcing material 11 comprising a bundled fibrous material of superior tensile strength. Therefore when vibration is applied to a joint during an earthquake or the like, undesirable situation such as the joint rupturing or the tenon pulling out can be prevented. As a result, the collapse of buildings or other structures constructed from such structural members can be prevented.

Furthermore, in comparison with the metal fixture reinforcement, the present reinforcement is carried out by a reinforcing material with lightweight, not bulky, and easy to handle. Therefore, an installation operation with simple and excellent operating efficiency is achieved, and the transportation and carrying of the reinforcing material is also simple. Moreover, in comparison to reinforcement using metal fixtures, the fiber reinforced material is able to absorb any shock applied to the joints of the structural members, and disperse the stress. In those cases where the fibrous material is bundled and then either twisted to form a twisted rope type material or woven to produce a braided type material, the shock absorbing effect of the reinforcing material 11 is particularly large. Furthermore in comparison with metal fixtures, the cutting of a reinforcing material 11 comprising bundled fibers is relatively simple, and so the length of the reinforcing material 11 can be easily adjusted depending on the circumstances.

In addition, dew condensation will not develop on the reinforcing material 11, meaning that rust will not develop. Because of no dew condensation does not develop, the problems of deterioration in the structural members, and termite damage can also be avoided. Moreover the fibrous material does not affect the aesthetic appeal of the building in the same way as metal fixtures.

In terms of fireproofing, the reinforcing material 11 shows heat resistant characteristics at temperatures above the permissible fire resistant temperature for timber of 260° C., and is ideally suited for use in fire protection construction type external walls. Furthermore, even if the anchoring of the reinforcing material by adhesive is carried out during winter, the insulating characteristics of timber shows that the temperature inside the apertures will not fall too low, and will be maintained at a temperature suitable for the curing of the adhesive.

Furthermore, by making the bend angle between the bonded section 11*a* comprising the intermediate portion of the reinforcing material 11, and the anchored sections 11*b* which comprise the opposite end sections of the reinforcing material which are to be anchored to the structural members, an obtuse angle, the amount of shearing force applied to the bend section can be reduced, enabling a further increase in the strength supplied by the reinforcing material 11. Moreover, by curving the corner of the aperture 12 where the reinforcing material 11 is installed, the amount of shearing force applied at the corner of the opening of the aperture 12 can be dispersed, enabling a further increase in the strength supplied by the reinforcing material 11.

In the example described above, the reinforcing material 11 was a simple bundle of a fibrous material, but it is also possible to have a reinforcing material 11 wherein the entire or a portion of fibrous material bundle, is impregnated with a resin. There are no particular restrictions on the types of resin impregnated, but resins such as the thermoplastic resin polypropylene and the thermosetting resin polyester are particularly suitable.

When a reinforcing material 11 impregnated with a thermoplastic resin is to be inserted in an aperture 12, then the part near the end of the linear reinforcing material 11, namely the section which will become the bend section, is heated and the resin impregnated in the fibrous material softened. If required the intermediate bonded section 11*a* can also be heated and softened.

In those cases where a thermosetting resin is used as the resin for impregnating the reinforcing material 11, the opposite end sections of the reinforcing material 11 are heat hardened, and then inserted into the apertures 12 and anchored with the adhesive 13, and in those cases where the intermediate portion is also impregnated with resin, the intermediate portion is then also heat hardened. By using a reinforcing material 11 comprising a fibrous material which has been impregnated with a resin, the fibrous material is maintained in a bundled state, thereby improving the handling and workability of the material.

In addition to the joints between the concrete continuous footing 1 and the sill 2, the concrete continuous footing 1 and the sill 2 and the post 3, and the sill 2 and the post 3, the structural reinforcement system described above can also be applied to joints between other structural members, such as between the sill 2 and a brace, the post 3 and a beam and a girder, two different beams, or a beam and a girder and a girt, or alternatively can be applied to the reinforcement of the joints between structural members such as concrete blocks, pre-cast concrete, stone, or brick.

Figure 4:
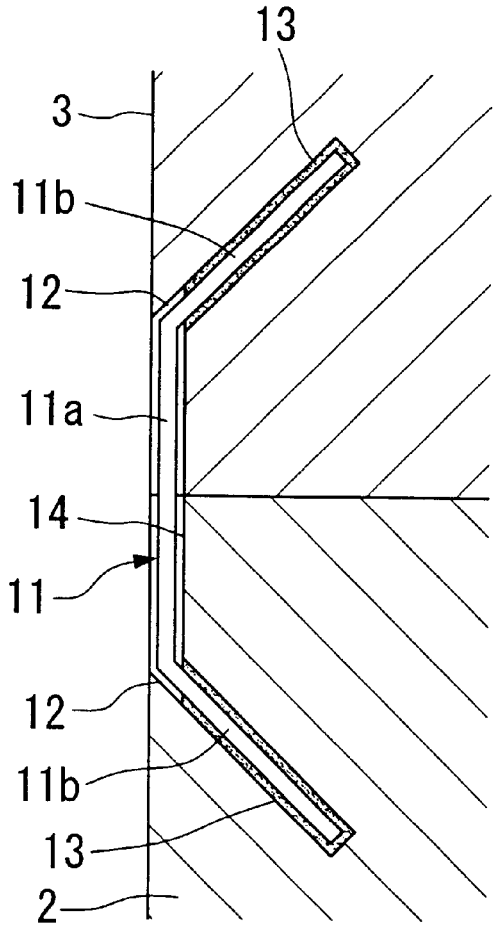
Figure 5:
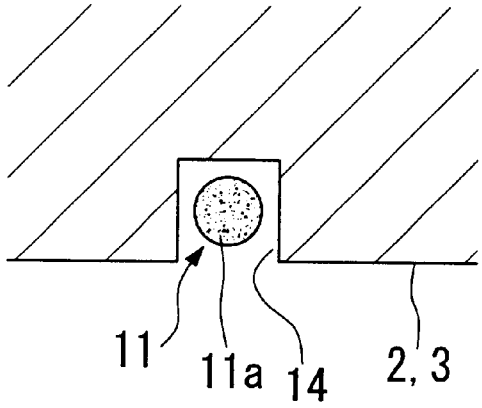

In the structural reinforcement system shown in FIG. 4 and FIG. 5, a channel (groove) 14 is formed on the surface of the members 2 and 3 in a position corresponding with the location of the bonded section 11*a* of the reinforcing material 11. In this manner, by forming a channel 14 and then installing the bonded section 11*a* inside the channel 14, the protrusion of the reinforcing material 11 can be eliminated.

In such a case, in addition to the adhesive inside the apertures 12, the structural members (the sill 2 and the post 3) and the reinforcing material 11 can be further bonded together by providing adhesive 13 either at the opposite ends of the channel 14, or along the entire length of the channel 14.

Figure 6:
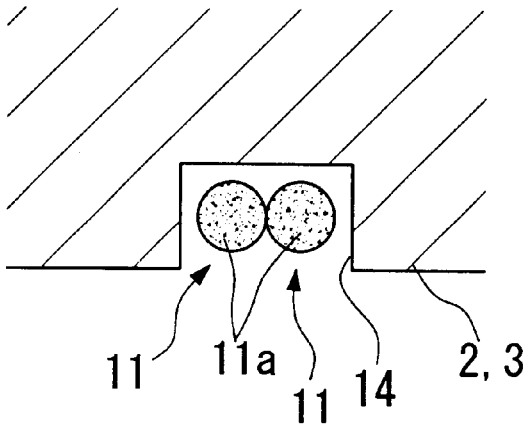

The structural reinforcement system shown in FIG. 6, shows a situation where plural reinforcing materials 11 in the same direction are provided inside a channel 14. It is possible to accommodate plural reinforcing materials 11 inside a channel 14 in this manner.

Figure 7:
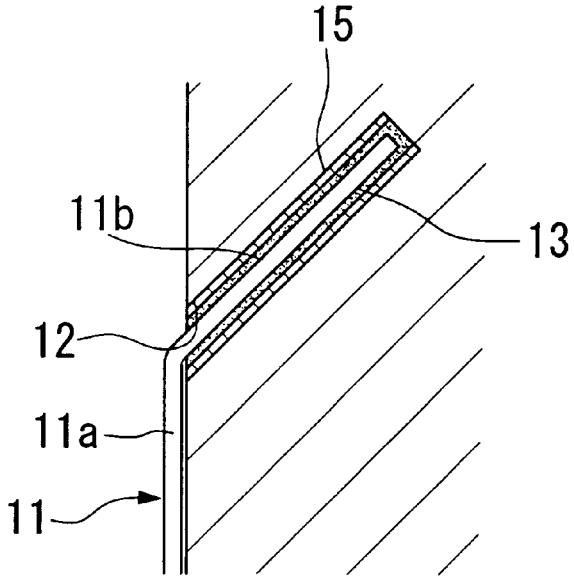

In the structural reinforcement system shown in FIG. 7, a reinforcing pipe 15 made of metal or the like is inserted inside an aperture 12, and the anchoring section 11*b* of the reinforcing material 11 is then inserted inside the reinforcing pipe 15 and fixed in place with an adhesive 13. By using the reinforcing pipe 15, the opening section of the aperture 12 will be protected by the reinforcing pipe 15 when a force acts on the reinforcing material 11, thereby preventing any damage to the opening section of the aperture 12, and enabling the reinforcing material 11 to be maintained in a state of good linkage with no slackness in the material. The reinforcing pipe 15 itself, is also fixed inside the aperture 12 with an adhesive.

Figure 8:
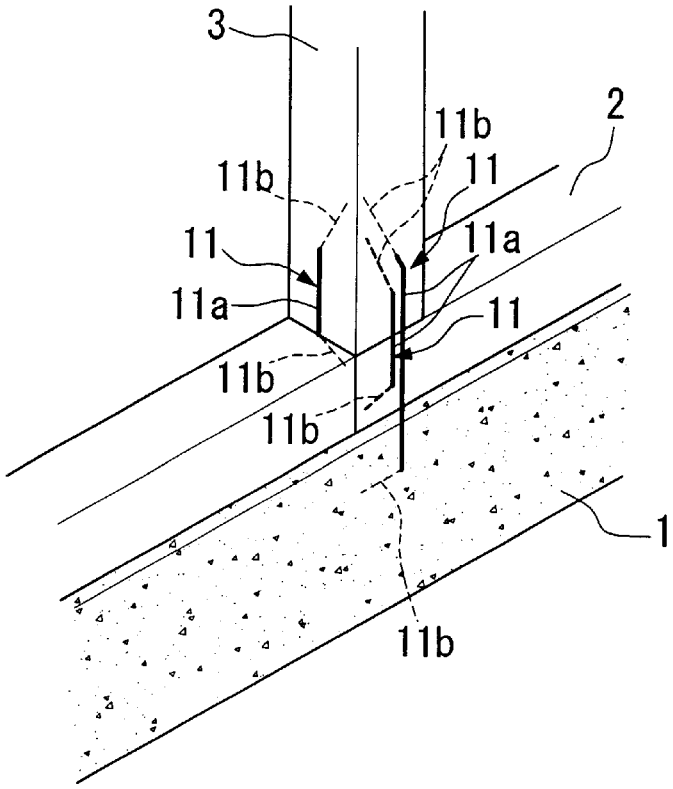
FIG. 8 through FIG. 14 are perspective views, each showing a structural reinforcement system of a joint section of structural members according to an embodiment of the present invention.

FIG. 8 shows a structural reinforcement system for a joint between a concrete continuous footing 1, a sill 2, and a post 3 away from a corner.

Figure 9:
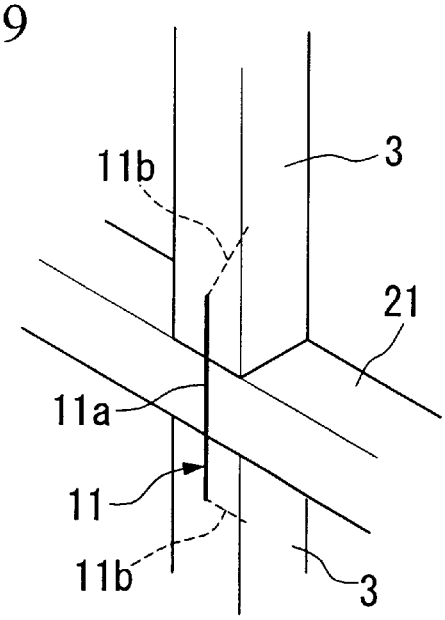
Figure 10:
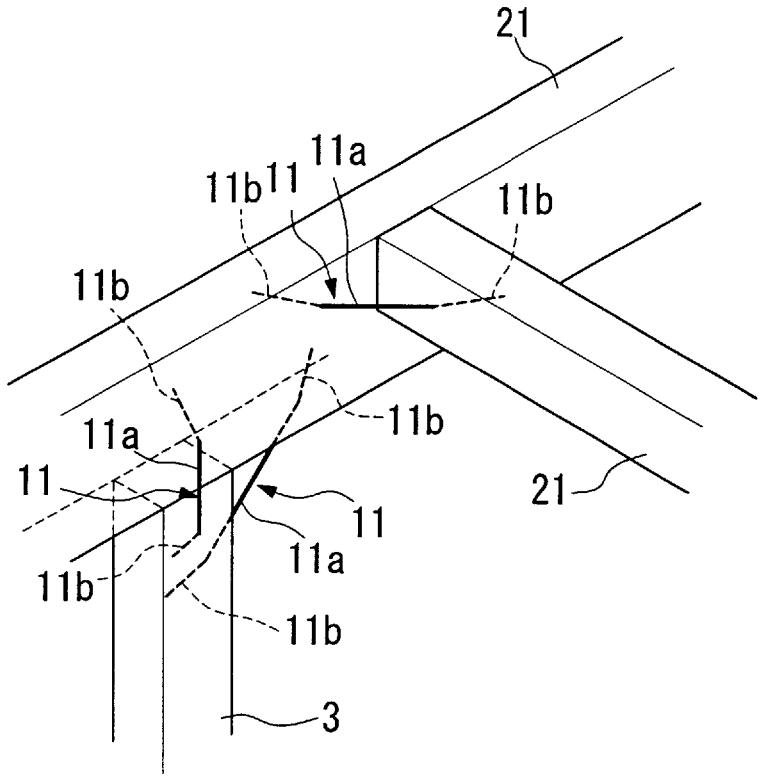
Figure 11:
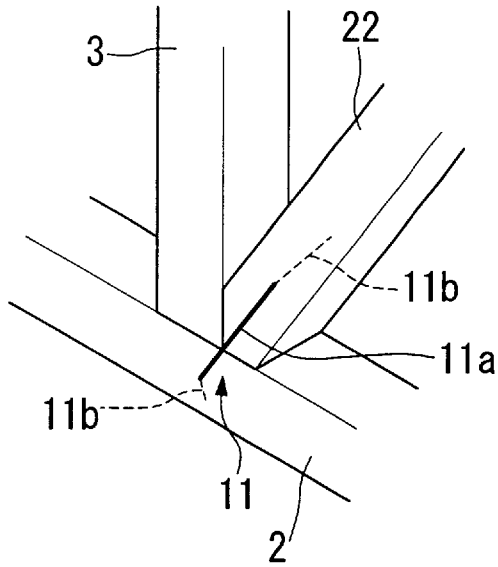

FIG. 9 through FIG. 11 show the use of structural reinforcement systems of the present invention adapted for joints between a sill 3 and a beam 21, between two different beams 21, and between a sill 2 and a brace 22 respectively.

Figure 12:
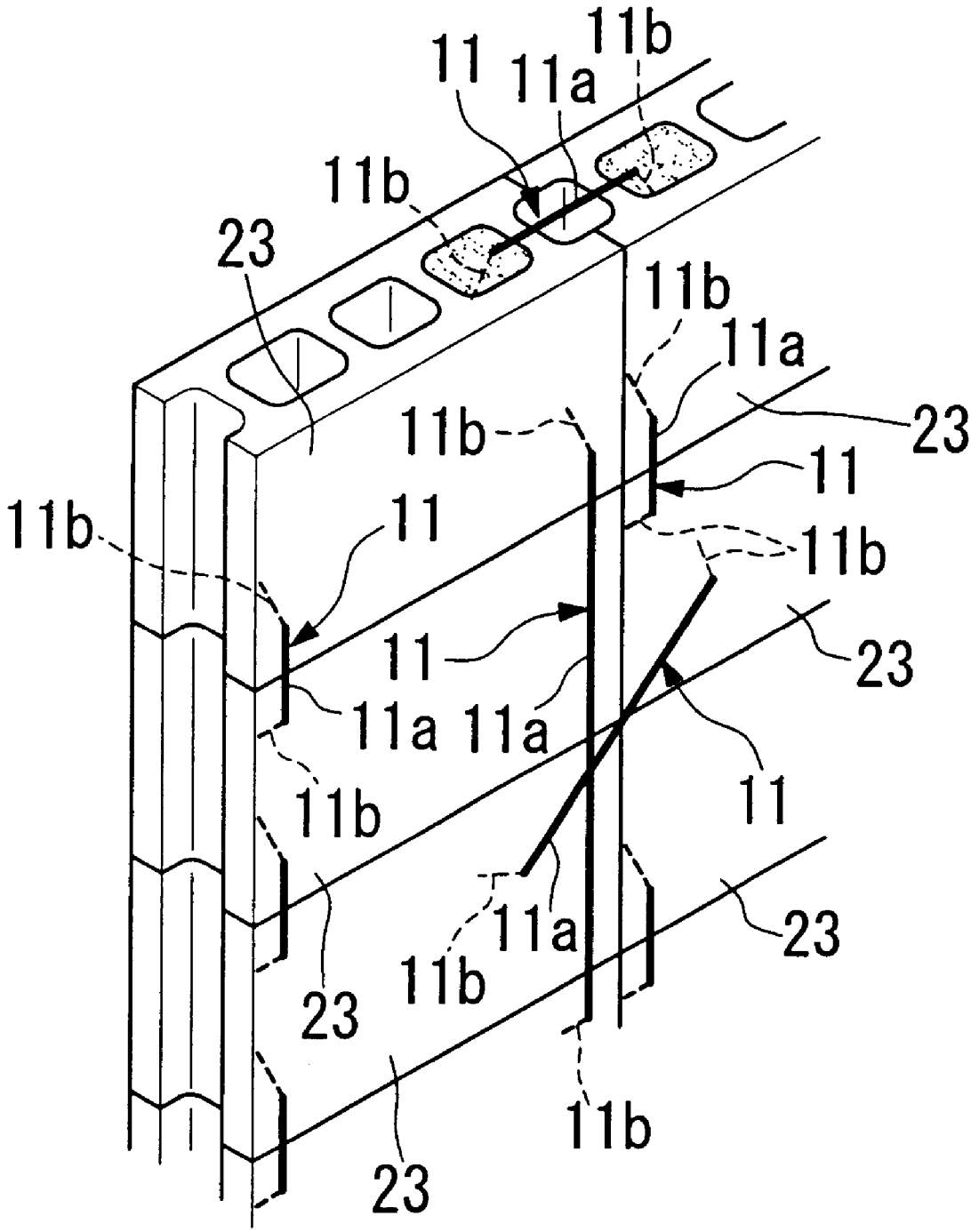

FIG. 12 shows a structural reinforcement system in which the joints between a series of blocks 23 are reinforced using a reinforcing material 11 of the present invention.

Figure 13:
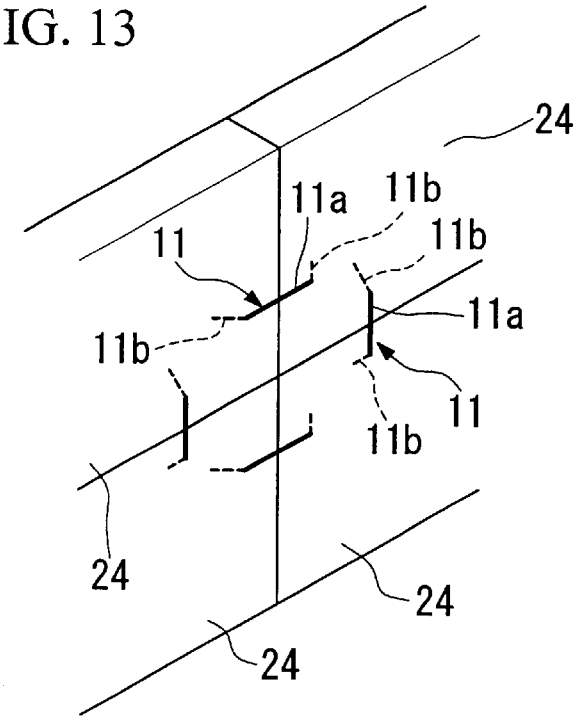

FIG. 13 shows a structure in which the joints between a series of pre-cast concrete slabs 24 are reinforced using a reinforcing material 11 of the present invention.

Figure 14:
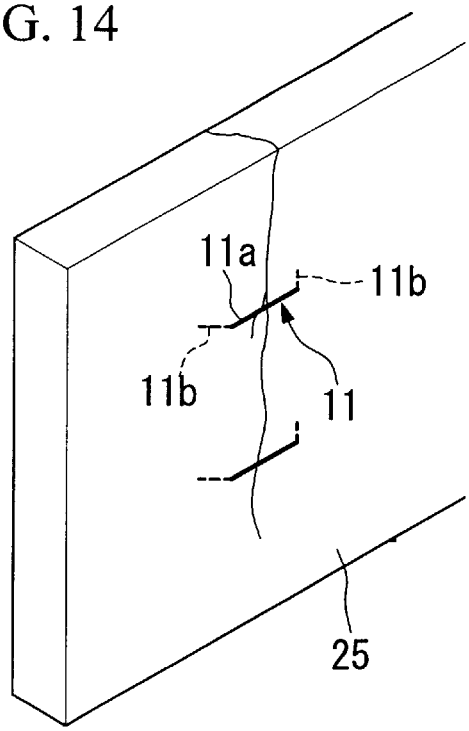

FIG. 14 shows a structure in which reinforcing material 11 is installed spanning a crack in a wall 25 in order to reinforce the structure. In this example, the joint (joint section) between the cracked sections of the wall 25 is reinforced using the reinforcing material 11.

EXAMPLES

The end surfaces of two timber structural members (105 mm×105 mm×350 mm) were brought together, and a reinforcing material then fixed across the joint between the two structural members under the conditions described below. Next, the tensile strength and the stretch of the reinforcing material was measured by applying a lengthwise tensile load to the structural members.

EXPERIMENT 1

Reinforcing material: bundled aramid fibers of diameter 3 mm
Number of strands of reinforcing material: two (used in a bundled form)
Aperture angle: 150° and 135°
Aperture depth: 100 mm
Aperture diameter: 5 mm
Adhesive: epoxy resin type adhesive

EXPERIMENT 2

Reinforcing material: bundled aramid fiber of diameter 6 mm
Number of strands of reinforcing material: one
Aperture angle: 150° and 135°
Aperture depth: 100 mm
Aperture diameter: 8 mm
Adhesive: epoxy resin type adhesive

Result of Experiment 1

In the case of an aperture angle of 150°:

Tensile strength: 8.6 KN Final stretch amount: 5 mm

In the case of an aperture angle of 135°:

Tensile strength: 8.4 KN Final stretch amount: 4 mm

Result of Experiment 2

In the case of an aperture angle of 150°:

Tensile strength: 16.2 KN Final stretch amount: 12 mm

In the case of an aperture angle of 135°:

Tensile strength: 14.7 KN Final stretch amount: 10 mm

I claim:

1. A structural reinforcement system comprising:

structural members having a joint section between them; and a reinforcing material which comprises a bundled fibrous material and is positioned spanning said joint section between said structural members for reinforcing said joint section;

wherein opposite end sections of said reinforcing material are fixed in apertures respectively formed in said structural members, and a center line of each of said apertures is inclined with respect to a line connecting openings of said apertures.

2. A structural reinforcement system for reinforcing a joint section between structural members according to claim 1, wherein at least a portion of said reinforcing material is impregnated with a resin.

3. A structural reinforcement system comprising:

structural members having a joint section between them; and a reinforcing material which comprises a bundled fibrous material and is positioned spanning said joint section between said structural members for reinforcing said joint section;

wherein said opposite end sections of said reinforcing material are fixed in apertures respectively formed in said structural members, and an angle formed between a center line of each of said apertures and a line connecting openings of said apertures is between 135 to 160 degree.

4. A structural reinforcement system for reinforcing a joint section between structural members according to claim 1, wherein said reinforcing material is a bundle of at least one of the materials selected from the group consisting of aramid fiber, nylon fiber, carbon fiber, glass fiber, and steel fiber.

5. A structural reinforcement system for reinforcing a joint section between structural members according to claim 1, wherein a channel is formed which connects openings of said apertures, and a central portion of said reinforcing material is accommodated inside said channel.

6. A structural reinforcement system for reinforcing a joint section between structural members according to claim 1, wherein a pipe is fixed inside at least one of said apertures, and an end section of said reinforcing material is fixed inside said pipe.

7. A structural reinforcement system for reinforcing a joint section between structural members according to claim 1, wherein said reinforcing material is a fibrous material in a twisted form or a braided form.

8. A reinforcing method for a joint section between structural members, comprising:

a step of forming apertures in joined structural members so that a center line of each said apertures is inclined with respect to a line connecting openings of said apertures;

a step of filling said apertures with an adhesive; and a step of inserting end sections of a reinforcing material comprising a bundled fibrous material into said apertures and fixing said end sections in place with said adhesive.

9. A reinforcing method for a joint section between structural members according to claim 8, wherein for said reinforcing material one in which opposite end sections are impregnated with a resin, and a central portion is not impregnated with a resin is used.

10. A reinforcing method for a joint section between structural members according to claim 8, wherein said reinforcing material is entirely impregnated with a resin, and during insertion of opposite end sections of said reinforcing material into said apertures, a central portion of said reinforcing material is softened, and subsequently re-hardened after said insertion.

11. A reinforcing method for a joint section between structural members according to claim 8, further comprising: a step of forming a channel which connects openings of said apertures, and a step of forming a channel which connects openings of said apertures, and a step of accommodating a central portion of said reinforcing material within said channel.

* * * * *